US005113621A

United States Patent [19]

Grimes

[11] Patent Number: 5,113,621

[45] Date of Patent: May 19, 1992

[54] ACCUSET MICROMETER LATHE

[75] Inventor: David B. Grimes, Greenfield, Mass.

[73] Assignee: Montague Industries, Inc., Turners Falls, Mass.

[21] Appl. No.: 396,657

[22] Filed: Aug. 22, 1989

[51] Int. Cl.[5] ..... B24B 53/04

[52] U.S. Cl. ..... 51/5 D; 51/165.8; 125/11.03; 125/11.21

[58] Field of Search ..... 51/5 D, 165.8, 165.87, 51/165.77; 125/11.03, 11.18, 11.21, 11.02, 11.01

[56] References Cited

U.S. PATENT DOCUMENTS

| | | | |
|---|---|---|---|
| 1,070,328 | 8/1913 | Curtis | 125/11.03 |
| 1,555,612 | 9/1925 | Riley | 125/11.03 |
| 2,477,418 | 7/1949 | Polk | 125/11.03 |
| 2,482,784 | 9/1949 | Lohutko | 125/11.03 |
| 2,482,785 | 9/1949 | Lohutko | 125/11.03 |
| 2,652,661 | 9/1953 | Flanders et al. | 83/227 |
| 3,457,678 | 7/1969 | Temple | 51/5 R |
| 4,235,218 | 11/1980 | Iida et al. | 125/11.03 |
| 4,423,570 | 1/1984 | Bartosek | 51/165.88 |
| 4,897,967 | 2/1990 | Maruyama et al. | 125/11.03 |

*Primary Examiner*—Robert A. Rose
*Attorney, Agent, or Firm*—Malcolm J. Chisholm, Jr.

[57] ABSTRACT

An apparatus is described that converts a manual adjustment procedure of a lathe on an existing pulp-grinding machine into an automated electronic procedure. The pre-existing lathe has a sharpening burr affixed to a movable plunger. The plunger is manually lowered by a hand crank until the burr contacts a surface of a pulp-grinding stone. The present invention replaces the hand crank with a reversible, variable speed motor. A transducer is affixed to the plunger wherein electric signals are produced in response to vibrations resulting from contact between the burr and the grinding stone. The signals are processed by a standard programmable controller to control the motor. An electronic encoder electrically measures the position of the plunger and communicates the position to the programmable controller. When the burr on the plunger contacts the grinding stone, the motor is programmed to automatically stop. The controller can then direct the motor to move the plunger the precise depth required for a specific burr, prior to the lathe making a horizontal pass along the stone. The controller records the contact position of the plunger for the next sharpening procedure.

5 Claims, 5 Drawing Sheets

ACCUSET MICROMETER LATHE

BACKGROUND OF THE INVENTION

This invention is another improvement to the pulpwood grinding machine described in U.S. Pat. No. 4,669,166, issued Jun. 2, 1987, to the present Applicant, David B. Grimes. Both that invention and this one have been assigned to Montague Industries, Inc. (d.b.a. Montague Machine Co.) of Turners Falls, Mass.

The present invention relates to lathes and more particularly to lathes that sharpen the cylindrical grinding stones used in pulpmaking machinery.

As described in U.S. Pat. No. 4,669,166, since the invention of "pulp" paper, wood has been traditionally ground into pulp. This soft moist mass is then combined with various liquids and additional fibers to produce the type of paper most often used today.

To make the pulp, large grinders have been used. One such machine is the Great Northern Waterous Grinder manufactured by Montague Industries, Inc.

To use the "Great Northern" (shown in FIG. 1), logs are first loaded into a top chute or hopper. From there, they fall into an underlying pocket or grinding chamber where they are pressed against a cylindrical grinding stone by a hydraulically operated piston. Rotations of the stone break down the logs and grind them into fibers. The fibers are mixed with water to form the pulp.

The "pulp stone" has a series of helical grooves in its grinding surface. These grooves spiral around the stone's central, rotational axis parallel to one another.

During the stone's rotation, these grooves help to break down the logs. The high-speed abrasion, caused by shoulders of the grooves contacting the logs, breaks down lignin in the wood allowing wood fibers to separate from the log.

Over time, the outer surface of the cylindrical stone becomes worn. The side shoulders or edges of the grooves become dull and the grooves become shallow. At that point the grooves need to be resharpened or "dressed".

As with most grinders, the Great Northern Waterous Grinder is equipped with its own lathe. This lathe has a dressing wheel, or burr, which is mounted on a hydraulically or electrically activated carriage to travel axially along the outer surface of the grinding stone. As it moves, the burr resharpens the dull grooves. Ideally, the grooves should attain their original depth, and cutting shoulders of the grooves should attain their original sharpness.

In a typical pulp grinding operation, the grinding machine runs continuously from day-to-day. The diameter of the grinding stone is approximately sixty-seven inches (67"), and it typically rotates at between two hundred and fifty (250) and three hundred and fifty (350) revolutions per minute. The diameter of the burr is approximately five inches (5"). The burr has no independent rotational power and, upon contact with the grinding stone, rotates in direct proportion to the rate of rotation of the stone.

The helical grooves on the grinding stone need to be dressed approximately once per day. It is impractical to stop or slow down the stone to dress the grooves. The precision of regular dressing, or resharpening, operations will largely determine the duration of the useful life of the grinding stone. Grinding stones may last only six (6) months or as long as three (3) years.

A critical step in the dressing operation is setting the burr at the proper depth so that it does not take off too much of the surface of the grinding stone. The stone is typically a matrix of very hard abrasive particles in a porous glass medium. The hard surface of the burr has the ability to rapidly crush too much of the stone's surface. Additionally, the surface of the burr has helical ridges that are to ride in the aligned grooves on the surface of the grinding stone. If the burr is set too deeply, not only will too much of the stone's surface be removed, but also the ridges may not be properly aligned with the grooves, causing unnecessary distortion of the grooves.

Currently, most lathes set the depth of the burr by having an operator physically observe a "spark point". The burr is mounted on a bottom end of a plunger, which is manually lowered and raised by a hand wheel or crank attached to the plunger by a screw assembly. A calibrated disk on the screw assembly allows the operator to measure the position of the plunger and burr.

As the plunger descends, the operator awaits visual observation of sparks indicating contact between the burr and grinding stone. The operator then manually sets a plunger stop based upon the position reading from the calibrated disk. Once contact between burr and stone is made, the plunger is set to descend a specific, minimum depth beyond the contact point and the lathe then moves the burr axially along the surface of the grinding stone. One pass along a four-foot stone is typically adequate and usually takes between two (2) and three (3) seconds.

When the grinding stone is to be dressed on the next day, the operator starts a search for the "spark point" based upon the previous day's position readings from the calibrated disk. The readings are posted in the machine's log book.

Some lathes measure the necessary depth of plunger descent by affixing a sensor to the burr. The burr rotates when it contacts the surface of the grinding stone and the sensor detects the rotation and signals the operator.

One of the problems of the "spark point" burr-setting procedure is that the actual depth of the plunger descent is dependent upon human reaction time. However accurate a specific operator may be, subsequent operators will not react at the same speed. Consequently, inconsistent depth settings are invariably produced and the grinding stone simply cannot achieve its maximum life span.

Another problem is that the "spark point" system is readily susceptible to substantial waste as a result of human error. An operator may improperly write down a specific measurement entry in the log of the grinding machines, or misread the entry. The result could easily lead to the plunger descending rapidly too far, forcing the burr to destroy a segment of the stone. Moreover, an operator may simply neglect to set the plunger stop and allow it to descend too far.

A significant problem with the "rotation sensing" burr-setting mechanism is that any sensor on or near the burr is exposed to an extremely harsh environment. The burr is routinely exposed to intense vibration, condensing steam, corrosive liquids, high pressure hoses and rapid temperature fluctuations. A sensor affixed to or near the burr would involve considerable maintenance and cost problems.

Accordingly, it is the primary object of the present invention to provide an improved apparatus which electronically stops the movement of a lathe plunger immediately upon contact between a burr affixed to the plunger and a surface to be sharpened by the lathe.

It is another object to provide an apparatus which electronically measures and records the position of a lathe plunger so that each time a sharpening cycle is commenced the plunger can rapidly move to the previously recorded position instead of slowly searching for a contact point between the burr affixed to the plunger and the surface to be sharpened by the lathe.

It is yet another object to provide an apparatus, commensurate with the above-listed objects, where its components are not exposed to harsh environmental conditions adjacent to the surface being sharpened.

It is a still further object to implement the present invention through a simple retrofit process on an existing pulpwood grinding machine.

The above and other objects and advantages of this invention will become more readily apparent when the following description is read in conjunction with the accompanying drawings.

SUMMARY OF THE INVENTION

To overcome these problems, Applicant has developed a novel apparatus and method for converting the existing procedure for setting the position of a sharpening or "dressing" burr on prior pulp-grinding machines from a manually operated procedure to an electronic one.

In the preferred embodiment, the invention basically comprises a transducer which is affixed to an enclosed top-end of the existing lathe plunger. The transducer produces an electric signal in response to contact vibrations created when the burr on a bottom end of the plunger contacts the surface of the pulp-grinding stone. The signal produced by the transducer is processed by electronic filtering components to control an electric motor. The motor rotates a shaft that engages a ball-screw assembly secured to the plunger. The precise position of the plunger is measured by an electronic encoder which is coupled to the shaft. The identity of the plunger position is electronically transmitted to the electronic components controlling the motor.

When an operator commences a sharpening cycle, the motor rotates the shaft in a direction that causes the plunger to descend toward the rotating surface of the cylindrical grinding stone. Immediately upon contact between the burr at the bottom of the plunger and the stone, a vibration is initiated which is sensed by the transducer. The transducer instantaneously signals the motor to stop the descent of the plunger. The encoder then records the exact position of the plunger and the position identity is transmitted to the electronic components controlling the motor. The operator then directs the motor to withdraw the plunger and sets the electronic components to drive the plunger the exact depth below the measured contact point between the burr and stone that is required for a specific sharpening burr. The plunger is then driven downward by the motor and, immediately upon reaching the proper sharpening depth, the lathe starts its horizontal pass across the surface of the stone.

When the next sharpening cycle is commenced, the encoder has already transmitted to the memory of the electronic components the precise identity of the depth position of the plunger on the previous sharpening cycle. The operator simply sets the electronic components to drive the plunger a precise required depth below the previous setting and initiates the descent of the plunger and the subsequent horizontal pass across the surface of the stone.

The preferred method of the present invention is a simple retrofit process. It basically includes affixing a transducer to an enclosed, top-end of the existing plunger; replacing a hand wheel or crank, that is affixed to a shaft controlling the position of the plunger, with an electronic motor and worm gear assembly; coupling an encoder to the shaft to identify the plunger position by measuring the number of shaft turns; and, transmitting the signal produced by the transducer in response to contact vibrations, and the identity of the plunger position recorded by the encoder, to electronic components that control the electric motor.

DETAILED DESCRIPTION OF THE PREFERRED EMBODIMENT

Figure 3:
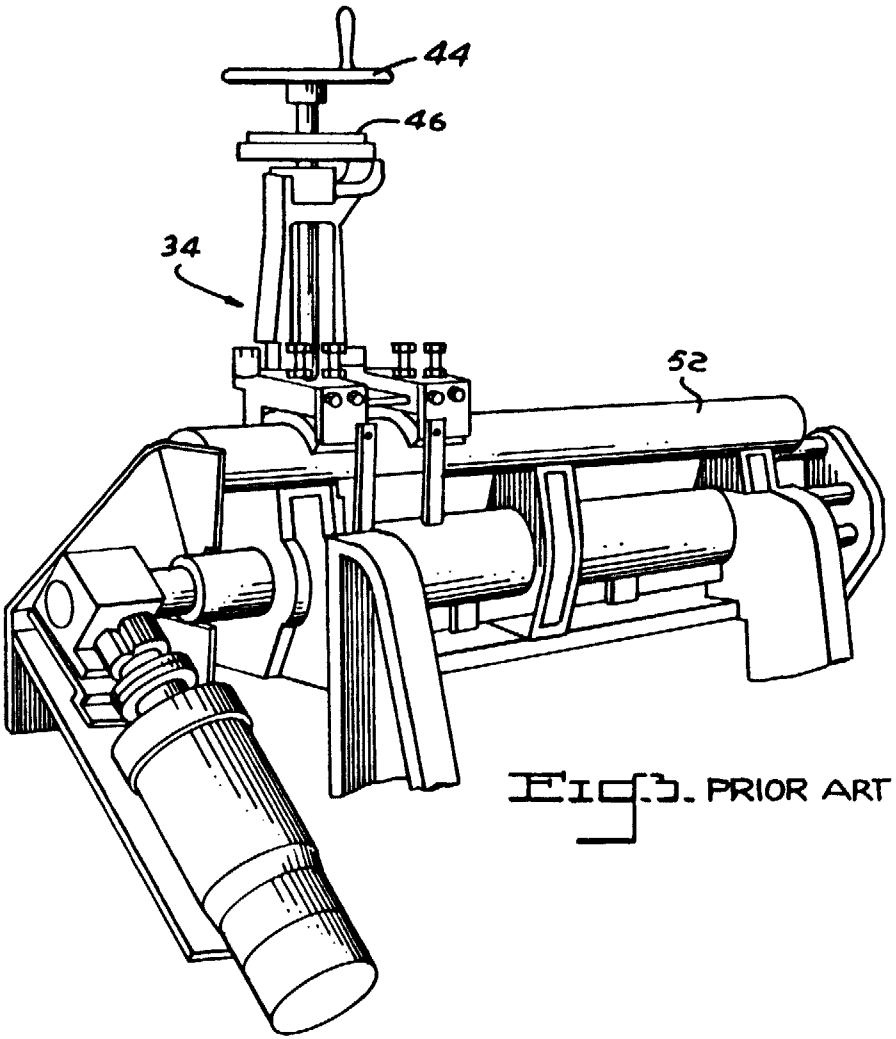
FIG. 3. PRIOR ART
FIG. 3 is a fragmentary rear perspective view of a prior art, manually set lathe shown in FIG. 2.
Figure 4:
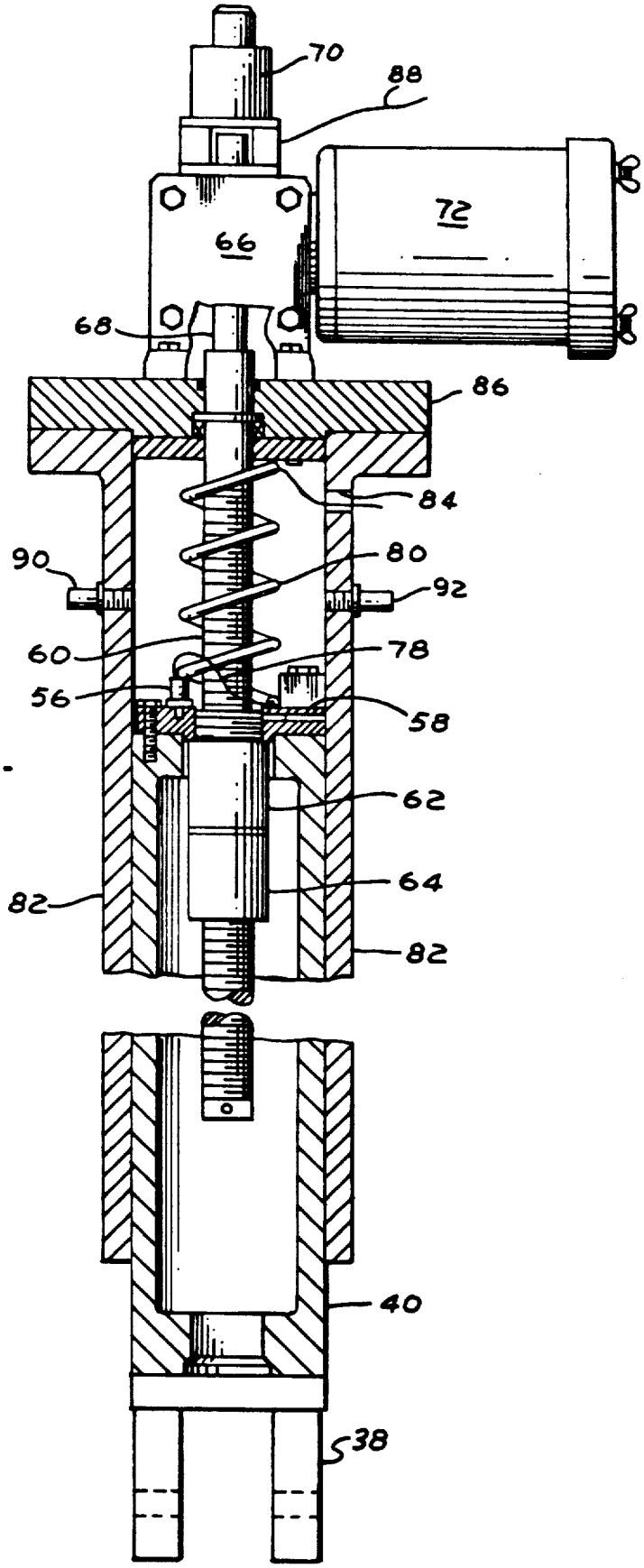
FIG. 4 is a cross-sectional side plan view of the ACCUSET TM micrometer lathe of the present invention.
Figure 5:
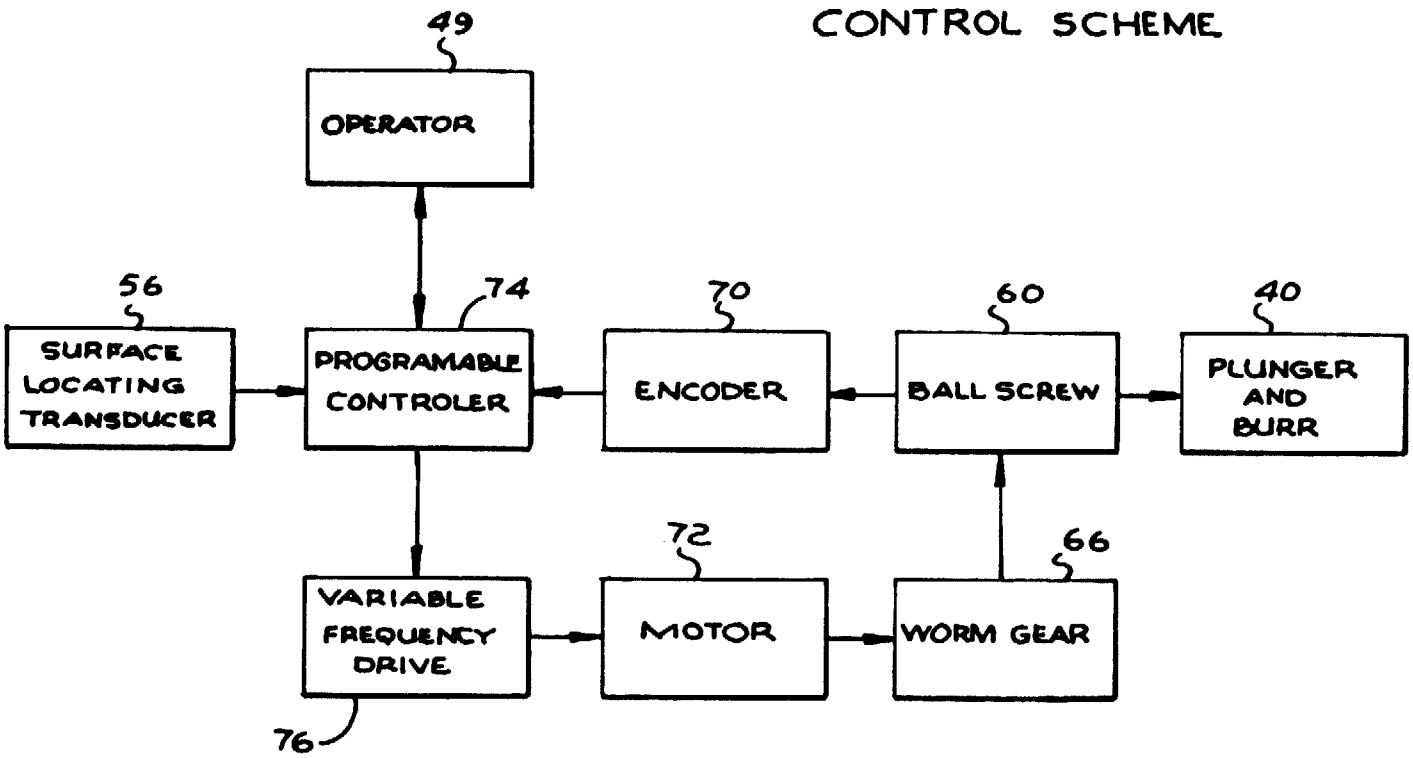
FIG. 5 is a diagrammatic view of a flow sheet depicting the control scheme for the ACCUSET TM micrometer lathe.
Figure 6:
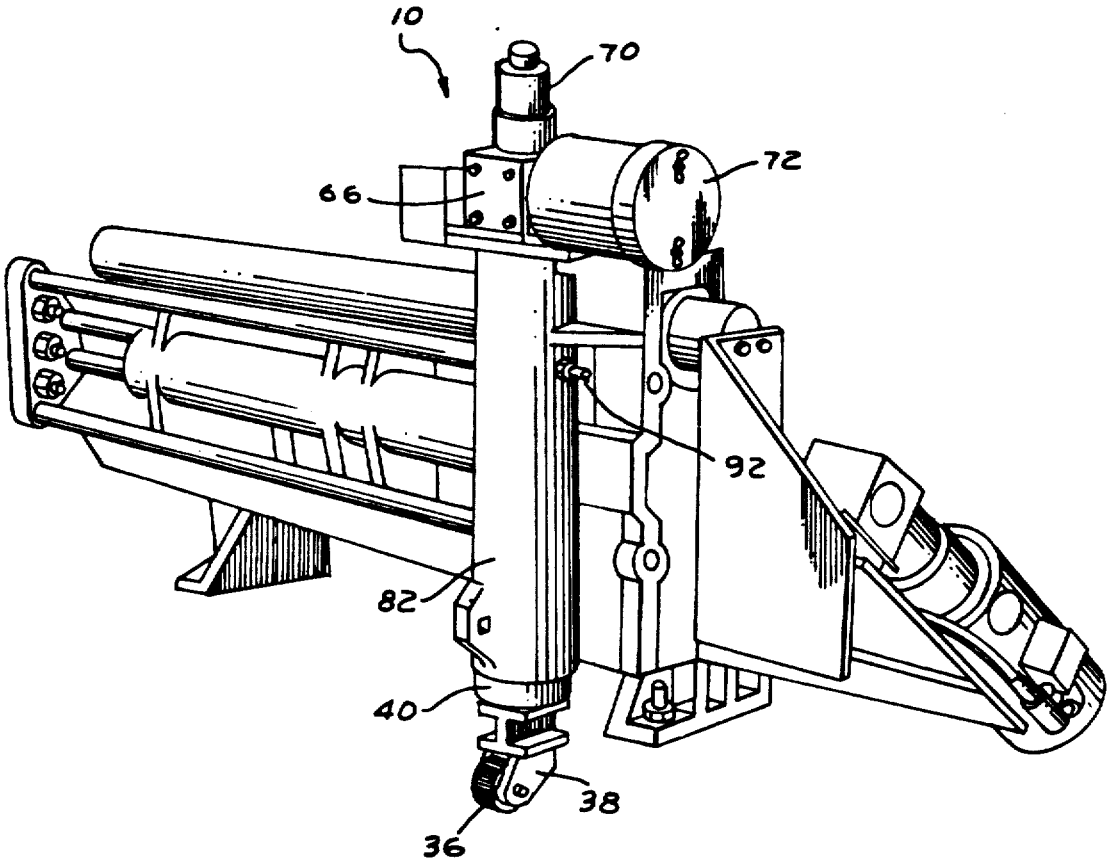
FIG. 6 is a front perspective view of an electronically controlled, retrofit lathe used to replace the FIGS. 2, 3 lathe and which is constructed in accordance with the present invention.

Referring to the drawings in detail, a novel micrometer lathe is shown in FIGS. 4–6 and generally designated by the numeral 10. The lathe 10 is attachable to the top of standard pulp grinders, such as the Great Northern Waterous Grinder 12 shown in FIGS. 1–3, and can be either a retrofit or an original equipment item. It is presently marketed under the trademark ACCUSET TM by Montague Industries, Inc. of Turners Falls, Mass.

Figure 1:
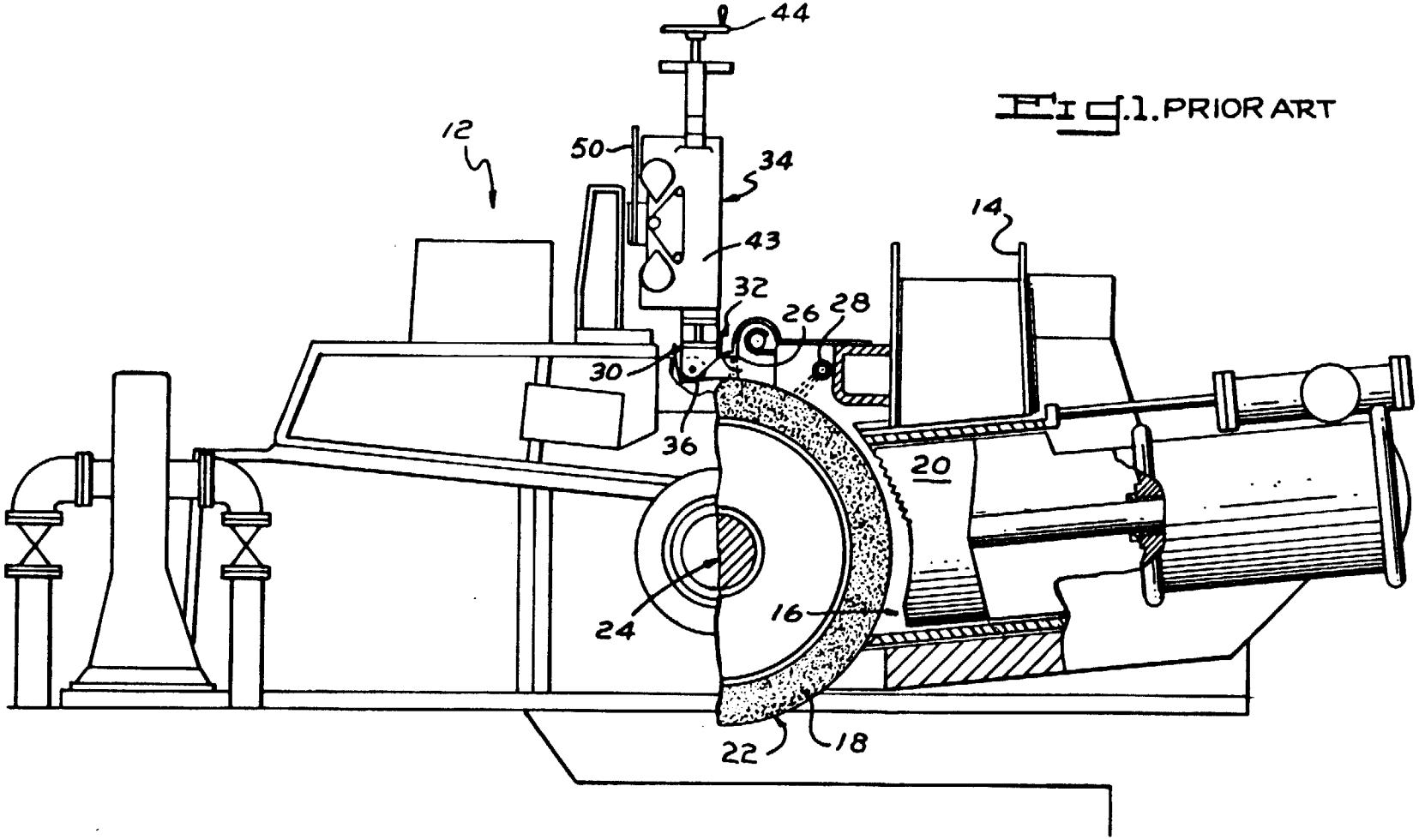
FIG. 1. PRIOR ART
FIG. 1 is a schematic side view of the aforementioned prior art Great Northern Waterous Grinder in basic outline form, with a mid-portion being illustrated in cross-sectional detail to depict certain key parts.
Figure 2:
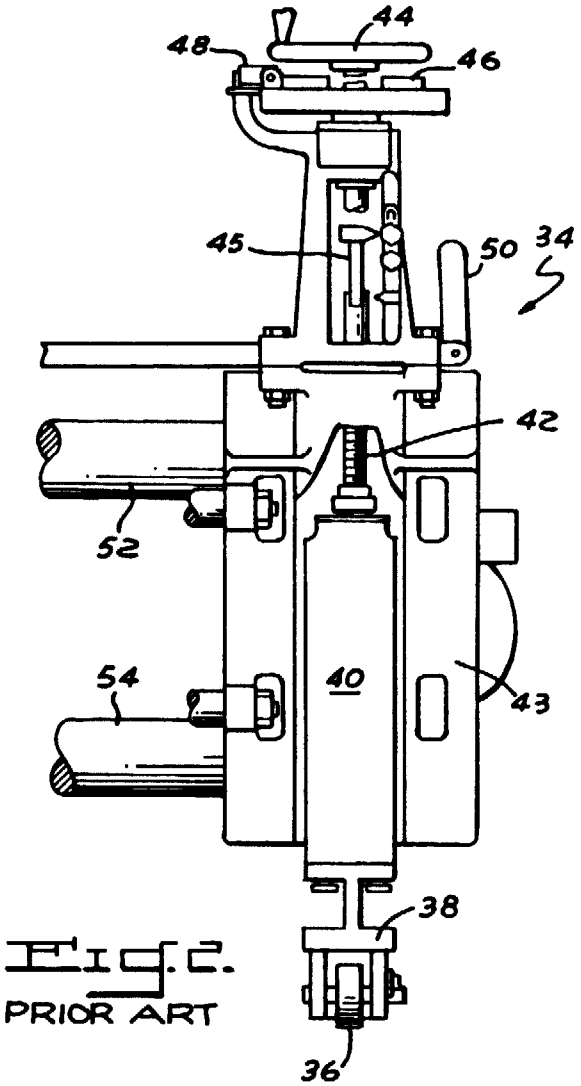
FIG. 2. PRIOR ART
FIG. 2 is a fragmentary side plan view of a prior art, manually set lathe shown in FIG. 1.

To understand the lathe 10, it is necessary to first understand the environment in which it works—namely, the pulp-grinding machines for which the invention was designed. As best shown in FIGS. 1–3, these prior machines typically include a top chute or hopper 14 into which logs (not shown) are first loaded. From there the logs fall into an underlying pocket or grinding chamber 16, where they are pressed against a rotating, cylindrical grinding stone 18 by a hydraulically operated piston 20. The rotation of the porous, glass-matrix "pulp stone" 18 breaks down the logs into fibers (not shown). The fibers are mixed with water to form pulp.

The "pulp stone" 18 has helical grooves (not shown) that extend the entire length of its grinding surface 22. They spiral around the stone's central, rotational axis 24 and are parallel to one another.

During the stone's rotation, helical cutting edges or shoulders of the grooves help to break down the logs. To assist in breakdown and to prevent undue wear of the shoulders, water is sprayed onto the grooves through nozzles 26, 28. This spray also mixes with wood particles (not shown) near the top of the stone.

Most of this mixture falls back into the grinding chamber 16. However, some grit escapes. As shown by directional arrows 30. 32, this grit escapes out an upper opening of the Great Northern Machine, where it contaminates any exposed components of overlying parts.

Over time, the grooves become subject to wear and need to be resharpened or "dressed". To achieve this, the Great Northern 12 has previously used a hydraulic or electric lathe 34. This lathe includes a dressing wheel or burr 36. As seen in FIG. 2, the wheel 36 rotates within a U-shaped housing 38, which is part of an integral, vertically movable plunger 40 that is affixed to a spindle 42, within a cylindrical carriage 43.

An overlying hand-operated bell crank 44 is attached to the top of the spindle 42 via interconnecting rod 45. By turning the crank clockwise, the plunger 40 and dressing wheel 36 can be lowered to fit into the worn grooves on the surface of the grinding stone 22. Or, by turning the crank counterclockwise, the burr 36 can be raised away from the stone's grinding surface.

As shown in FIG. 2, a calibrated disk 46 and integral rotatable position indicator 48 are located directly beneath the bell crank 44 to mark the exact position of the crank. The disk is calibrated to indicate a specific vertical distance of travel of the plunger 40 for each segment of axial rotation by the crank.

To sharpen the grooves, an operator 49 (see FIG. 5) slowly lowers the dressing wheel 36 toward the rotating surface of the stone 22 by turning the ball crank 44 clockwise. The operator observes the descent of the wheel 36 and, when sparks (not shown) are observed (at the "spark point"), the dressing wheel is raised a specific slight distance. The operator notes on the calibrated disk 46 the position of the crank 44. Particular burrs 36 are designed to crush a specific depth off of the grinding stone. The operator marks a setting on the calibrated disk 46 that corresponds to the proper burr depth plus the depth necessary to return to the contact or spark point. The operator then turns the crank 44 to the depth marked on the disk 46, thereby lowering the dressing wheel to the approximate depth for sharpening the stone. When contact is made between the burrs on the wheel 36 and the surface of the stone 22, the operator pulls operating lever 50 which activates an electric or hydraulic mechanism (not shown) that moves the lathe 34 horizontally on guide arms 52, 54 along the surface of the grinding stone 22.

It is contemplated that the present invention's most prolific use, at least initially, will be as a retrofit for converting the aforementioned, manually adjusted lathe 34, into a unique electronically controlled one. Accordingly, the invention 10 (shown in FIGS. 4–6) will now be described in primarily "retrofit" terms.

The accuset micrometer lathe 10 basically comprises a transducer 56 that is affixed to a top-end 58 of the pre-existing plunger 40 and generates electrical signals in response to mechanical vibrations; a ball screw 60 that passes through a throughbore (not shown) in the top-end 58 of the plunger and is secured by nuts 62, 64 captured within the throughbore, wherein axial rotation of the ball screw 60 moves the plunger 40 vertically; a worm-gear box 66 coupled to a top-end 68 of the ball screw 60 that translates and gears down high-speed horizontal rotational force to low-speed vertical rotational force and minimizes backlash of the ball screw; an encoder 70, or electronic measuring means, attached to the worm-gear box 66 and also coupled to the top-end 68 of the ball screw 60, which generates an electric signal in response to rotation of the screw and converts the signal into a measurement identifying the exact position of the plunger 40; an electric motor 72 mounted to the worm-gear box 66 that horizontally rotates a worm (not shown) within the gear box; a programmable controller 74, or electric signal processing means, (see FIG. 5) that receives and processes electrical signals from the transducer 56 and encoder; and a variable frequency drive component 76 (see FIG. 5), electrically connected to the controller 74 and the motor 72, which receives processed signals from the controller and converts the signals to the proper electrical current to activate the motor for precise operation.

In converting the old, manually operated lathe 34, a standard transducer 56, such as an accelerometer, type 501M101, manufactured by Vibro-Meter Corp., Boston, Mass., is affixed to the top-end 58 of the plunger 40. The top-end of the plunger is further modified to capture and secure a ball screw 60 and nut 62, 64 assembly such as Type# RP-104, Model No. 8110-448-017, by Warner Electric Co. of South Beloit, Ill. After the ball screw assembly is secured a transducer electric wire 78 leads from the transducer 56 and is enclosed by a spiral wire protector 80 which spirals upward along the ball screw 60. The plunger 40 fits within a standard cylindrical carriage 82 and the transducer wire 78 exits the interior of the carriage through an exit port 84.

A carriage top-plate 86 encloses the top of the carriage and is adapted to secure the ball screw 60. A worm-gear box 66, such as Catalog No. F718-30-B5-H, 700 series, by Boston Gear of Quincy, Mass., is affixed to the top-plate 86 and receives and engages top-end 68 of the ball screw. The top-end passes through the gear box 66 and is coupled to a standard encoder 70 such as Rotary Encoder Model 845N-SJDN3-CMY1 by Allen Bradley Co. of Highland Heights, Ohio. Attached to the worm-gear box 66 is a standard electric motor 72 such as Catalog No. VBM3542, 56C Frame, Spec. 35E50-1864-B, by Baldor, Co. of Fort Smith, Ariz. It is mounted to the gear box 66 such that the rotational axis of the motor 72 is perpendicular to the rotational axis of the ball screw 60. The motor rotates the worm (not shown) in the gear box which engages and rotates the top-end of the ball screw 68.

An encoder electric wire 88 and the transducer wire 78 both lead to, and transmit signals to, a standard programmable controller 74 such as Model P.L.C. 2-05 by Allen Bradley Co. of Highland Heights, Ohio, with a signal conditioning component Model 438-D by Vitec Corp., of Cleveland, Ohio.

The signal transmitted from the transducer 56 is filtered by the signal conditioning component to filter out background signals produced by the transducer in response to vibrations resulting from ordinary operations. Signals produced by the transducer in response to contact between the burr or dressing wheel 36 affixed to the plunger 40 and the surface of the grinding stone 22 have sufficiently large amplitude to pass through the filter and programmable controller 74 to a variable frequency drive 76, such as Model 1334 by Allen Bradley.

The variable frequency drive 76 converts the electric signal received from the programmable controller 74 to the proper electrical current to drive the electric motor 72 a specific number of rotations, thereby causing the plunger 40 to move a specific distance.

The encoder 70 transmits a signal to the programmable controller 74 identifying the position of the ball screw 60 and hence the position of the plunger 40. The operator can program the programmable controller to signal the variable frequency drive 76 to stop moving the plunger 40 at specific, preset positions, identified by the encoder 70.

For example, in operation the operator 49 programs the controller 74 to have the plunger 40 descend in search of the surface 22 of the grinding stone 18. Upon contact between the rotating surface and the burr affixed to the plunger, a resulting vibration causes the transducer to signal the motor 72, via the programmable controller 74 and the variable frequency drive 76, to instantaneously stop, and then withdraw the plunger a specific, minute distance to stop the contact. The encoder 70 identifies the position of the plunger via measurements of the rotational position of the top-end 68 of the ball screw 60, and transmits the position identity to the controller 74. The operator can then program the controller to make the plunger descend the precise distance to again make contact plus an additional distance dependent upon the specific "crush dressing" depth requirements of the burr 36 being used. The operator then initiates the final plunger descent and, when the sharpening or dressing depth is reached, activates the horizontal pass of the lathe 10 across the surface 22 of the grinding stone 18.

The next time sharpening is required, typically one day later, the programmable controller 74 has stored in its electronic memory the positions utilized by the plunger for the previous sharpening. Consequently, the operator 49 can save time by avoiding a time-consuming contact point search. A search can be commenced from the contact position identified by the encoder 70 during the previous sharpening cycle.

Plunger 40 positions can also be identified by the encoder and set in the programmable controller 74, in the same manner described above, for minimum and maximum depth settings. These settings serve to prevent damage to the lathe in the event a plunger descends accidentally when no stone 18 is under the plunger. A minimum depth setting serves to automatically shut off the motor 72 when the plunger 40 ascends to a point near the carriage top plate 86, to avoid accidental damage to the lathe 10. Similarly, a maximum depth setting automatically shuts off the motor if the plunger descends too far. In the event the programmable controller 74 or encoder 70 fail, proximity switches 90, 92 such as Model E2A12, catalog 871C, manufactured by Allen Bradley Co., serve as electro-mechanical minimum and maximum plunger-positions stop. They shut down the motor 72 if triggered by the plunger 40, thereby serving to reduce the risk of accidental damage to the lathe.

It should be understood by those skilled in the art that obvious structural modifications can be made without departing from the spirit of the invention. For example, the same lathe position identifying and controlling apparatus and process described hereinabove for sharpening pulp-grinding stones can be used for any lathe. Accordingly, reference should be made primarily to the accompanying claims rather than the foregoing specification to determine the scope of the invention.

Having thus described the invention, what is claimed is:

1. In a pulp-grinding machine of the type having a rotatable, cylindrical grinding stone for breaking down logs and grinding them into fibers, wherein the stone has a series of helical grooves in its grinding surface and the machine has a movable plunger within a cylindrical carriage that allows the plunger to be lowered so that a burr on the plunger fits into the grooves to resharpen them as the carriage and plunger make an axial pass across the stone, the improvement comprising an electronic apparatus for positioning the burr in contact with the grinding stone, said apparatus comprising:

a. a variable speed, reversible electric motor coupled to the plunger, wherein the motor moves the plunger toward or away from the grinding stone;

b. a transducer, affixed to the plunger, that generates electric signals in response to vibrations created as a result of contact between the burr and the rotating grinding stone; and c. an electric signal processing means wired to the transducer and motor for processing the signal from the transducer to control the electric motor in moving the plunger.

2. The apparatus of claim 1, wherein the apparatus further comprises electronic measuring means engaging a shaft affixed to the plunger and wired to the signal processing means for electronically identifying the position of the plunger relative to the grinding stone and for transmitting the position identity to the electric signal processing means.

3. In a pulp-grinding machine of the type having a rotatable, cylindrical grinding stone for breaking down logs and grinding them into fibers, wherein the stone has a series of helical grooves in its grinding surface and the machine has a movable plunger within a cylindrical carriage that allows the plunger to be lowered so that a burr on the plunger fits into the grooves to resharpen them as the carriage and plunger make an axial pass across the stone, the improvement comprising an electronic apparatus for positioning the burr in contact with the grinding stone, said apparatus comprising:

a. a variable speed, reversible electric motor coupled to the plunger, wherein the motor moves the plunger toward or away from the grinding stone;

b. a transducer, affixed to the plunger, that generates electric signals in response to vibrations created as a result of contact between the burr and the rotating grinding stone;

c. an electric signal processing means wired to the transducer and motor for processing the signal from the transducer to control the electric motor in moving the plunger;

d. an electric measuring means engaging a shaft affixed to the plunger and wired to the signal processing means for electronically identifying the position of the plunger relative to the grinding stone and for transmitting the position identity to the electric signal processing means;

e. a worm-gear assembly mounted between the plunger and electric motor so that an end of the worm gear receives a shaft from the motor that rotates in an axis that is not perpendicular to the axis of rotation of the grinding stone and an other end of the worm gear engages a top end of a ball screw, affixed to the plunger, rotating it in an axis that is perpendicular to the axis of rotation of the grinding stone;

f. a ball screw and nut assembly, that includes the ball screw, coupled to the plunger and worm-gear assembly for movement of the plunger in an axis that is perpendicular to the axis of rotation of the grinding stone via the electric motor; and g. a proximity switch located within a wall of the carriage for electro-mechanically stopping the electric motor, and therefore the movement of the plunger, when the plunger contacts the proximity switch.

4. The apparatus of claim 2 wherein the apparatus further comprises a worm-gear assembly mounted between the plunger and electric motor so that an end of the worm gear receives a shaft from the motor that rotates in an axis that is not perpendicular to the axis of rotation of the grinding stone and another end of the worm gear engages a top end of a ball screw, affixed to the plunger, rotating it in an axis that is perpendicular to the axis of rotation of the grinding stone.

5. The apparatus of claim 4 wherein the ball screw is part of a ball screw and nut assembly that is coupled to the plunger and worm-gear assembly for movement of the plunger in an axis that is perpendicular to the axis of rotation of the grinding stone via rotation of the electric motor.

* * * * *